US008444400B2

(12) United States Patent
Khalil

(10) Patent No.: US 8,444,400 B2
(45) Date of Patent: May 21, 2013

(54) HYDRAULIC CYLINDER HAVING PISTON-MOUNTED BYPASS VALVE

(75) Inventor: Rabie E. Khalil, Joliet, IL (US)

(73) Assignee: Caterpillar Inc., Peoria, IL (US)

( * ) Notice: Subject to any disclaimer, the term of this patent is extended or adjusted under 35 U.S.C. 154(b) by 1069 days.

(21) Appl. No.: 12/370,831

(22) Filed: Feb. 13, 2009

(65) Prior Publication Data

US 2010/0209275 A1 Aug. 19, 2010

(51) Int. Cl.
*F04B 53/12* (2006.01)

(52) U.S. Cl.
USPC ..... 417/545

(58) Field of Classification Search
USPC ..... 417/545–550
See application file for complete search history.

(56) References Cited

U.S. PATENT DOCUMENTS 3,566,716 A * 3/1971 Chatterjea ..... 192/109 F
3,742,980 A 7/1973 Byers, Jr.
4,051,868 A 10/1977 Andersen
4,126,293 A 11/1978 Zeuner et al.
4,271,868 A 6/1981 Neff
4,407,323 A 10/1983 Neff
4,506,700 A 3/1985 Kramer
4,722,362 A 2/1988 Muschong et al.
4,754,693 A 7/1988 Teltscher
5,136,930 A 8/1992 Karakama et al.
6,296,019 B1 10/2001 Müller et al.
6,505,584 B2 1/2003 Lou
6,886,511 B1 5/2005 Tong et al.
7,090,475 B2 8/2006 Shrive
7,121,185 B2 * 10/2006 Alrefai ..... 91/1
2002/0108591 A1 8/2002 Lou
2003/0155437 A1 8/2003 Lei
2009/0212244 A1 * 8/2009 Pfaff et al. ..... 251/30.03

* cited by examiner

*Primary Examiner* — Anh Mai
*Assistant Examiner* — Hana Featherly
(74) *Attorney, Agent, or Firm* — Finnegan, Henderson, Farabow, Garrett & Dunner LLP

(57) ABSTRACT

A hydraulic cylinder is disclosed. The hydraulic cylinder may have a tube, and a piston disposed within the tube and having a bore passing through the piston. The hydraulic cylinder may also have a valve element disposed within the bore and having a length shorter than a length of the bore. The valve element may be mechanically movable to allow fluid flow through the bore, and hydraulically movable to inhibit fluid flow through the bore.

19 Claims, 5 Drawing Sheets

HYDRAULIC CYLINDER HAVING PISTON-MOUNTED BYPASS VALVE

TECHNICAL FIELD

The present disclosure relates generally to a hydraulic cylinder, and more particularly, to a hydraulic cylinder having a piston-mounted bypass valve.

BACKGROUND

Hydraulic cylinders are used to affect movement of various machine components, for example to affect movement of a linkage member or a work tool relative to a machine frame. A hydraulic cylinder includes a piston positioned within a tube to define a rod-end and a head-end chamber therein. Selectively supplying high-pressure fluid to one of the rod-end and head-end chambers, while selectively communicating the other chamber with a low-pressure reservoir, affects relative movement of the piston within the tube and, thus, movement of the linkage member or work tool.

Often, two or more hydraulic cylinders are used in tandem to affect substantially the same relative movement between two components. For example, two hydraulic cylinders are commonly interconnected between a boom member or a blade of an earth-moving machine and the machine frame to simultaneously affect lifting of the boom member or tilting of the blade. During extension or retraction of the two hydraulic cylinders, one of the hydraulic cylinders can reach an end-of-stroke position (i.e., bottom out) before the other hydraulic cylinder. And, because both hydraulic cylinders receive pressurized fluid from a common source, the pressurized fluid supplied to the bottomed-out hydraulic cylinder, and the resulting pressure force acting on the piston of that hydraulic cylinder, can transfer a reactionary force to the boom member or blade, the machine frame, and/or the other hydraulic cylinder that can cause damage to the machine components.

One attempt to reduce the reactionary force described above is disclosed in U.S. Pat. No. 5,425,305 (the '305 patent) issued to Mauritz on Jun. 20, 1995. Specifically, the '305 patent describes a hydraulic piston disposed within a cylinder and having a bore therethrough that is spaced apart from and axially parallel to an axis of the piston. A tubular spool with closed ends and circular stops threadingly attached to each end is disposed within the bore, and has a length greater than the bore. The tubular spool has cross ports at each end that run perpendicularly to an axis of the spool. The cross ports are situated as close to the ends of the spool as possible. The cross ports intersect a hollow center of the spool and allow hydraulic oil to flow through the piston via the passage at the center of the spool when the valve is in an open position.

When working fluid is applied to a face of the piston of the '305 patent to move the piston, the working fluid forces the spool into the bore until one of the circular stops at the face of the piston abuts a seat and thereby stops fluid flow through the cross ports and the passage of the spool. As the piston approaches an end-of-stroke, the opposing circular stop engages an end cap of the cylinder and is urged together with the spool back through the bore of the piston to re-open the cross ports and the passage, thereby fluidly communicating opposing faces of the piston. By fluidly communicating the opposing faces of the piston, a buildup of pressure at the faces is reduced so as to reduce the reactionary force.

Although the spool-type relief valve of the '305 patent may help reduce the reactionary force of a hydraulic cylinder, it may be problematic. In particular, spool-type valves are known to have misalignment problems that can result in binding and damage of the spool. Further, spool-type valves are known to leak and have flow control difficulties. In addition, the valve of the '305 patent includes multiple separate internal parts that can reduce a durability of the valve while increase the costs thereof.

The disclosed hydraulic cylinder is directed to overcoming one or more of the problems set forth above and/or other problems of the prior art.

SUMMARY

In one aspect, the present disclosure is directed to a hydraulic cylinder. The hydraulic cylinder may include a tube, and a piston disposed within the tube and having a bore passing through the piston. The hydraulic cylinder may also include a valve element disposed within the bore and having a length shorter than a length of the bore. The valve element may be mechanically movable to allow fluid flow through the bore, and hydraulically movable to inhibit fluid flow through the bore In another aspect, the present disclosure is directed to another hydraulic cylinder. This hydraulic cylinder may include a tube, a piston disposed within the tube and having a first hydraulic surface and a second hydraulic surface disposed in general opposition to the first hydraulic surface, and a valve body disposed within the piston and having formed therein a bore and a passage fluidly communicating the first hydraulic surface with the second hydraulic surface. The hydraulic cylinder may also include a valve element disposed within the bore of the valve body and being movable from a first position at which fluid flow through the passage is inhibited, toward a second position at which fluid flow through the passage is allowed.

In yet another aspect, the present disclosure is directed to another hydraulic cylinder. This hydraulic cylinder may include a tube, and a piston disposed within the tube and having a first hydraulic surface, a second hydraulic surface disposed in general opposition to the first hydraulic surface, and a bore passing through the piston from the first hydraulic surface to the second hydraulic surface. The hydraulic cylinder may also include a poppet valve element disposed within the bore and having formed therein a passage fluidly communicating the first hydraulic surface with the second hydraulic surface. The poppet valve element may be movable from a first position at which fluid flow through the passage is inhibited, toward a second position at which fluid flow through the passage is allowed.

DETAILED DESCRIPTION

Figure 1:
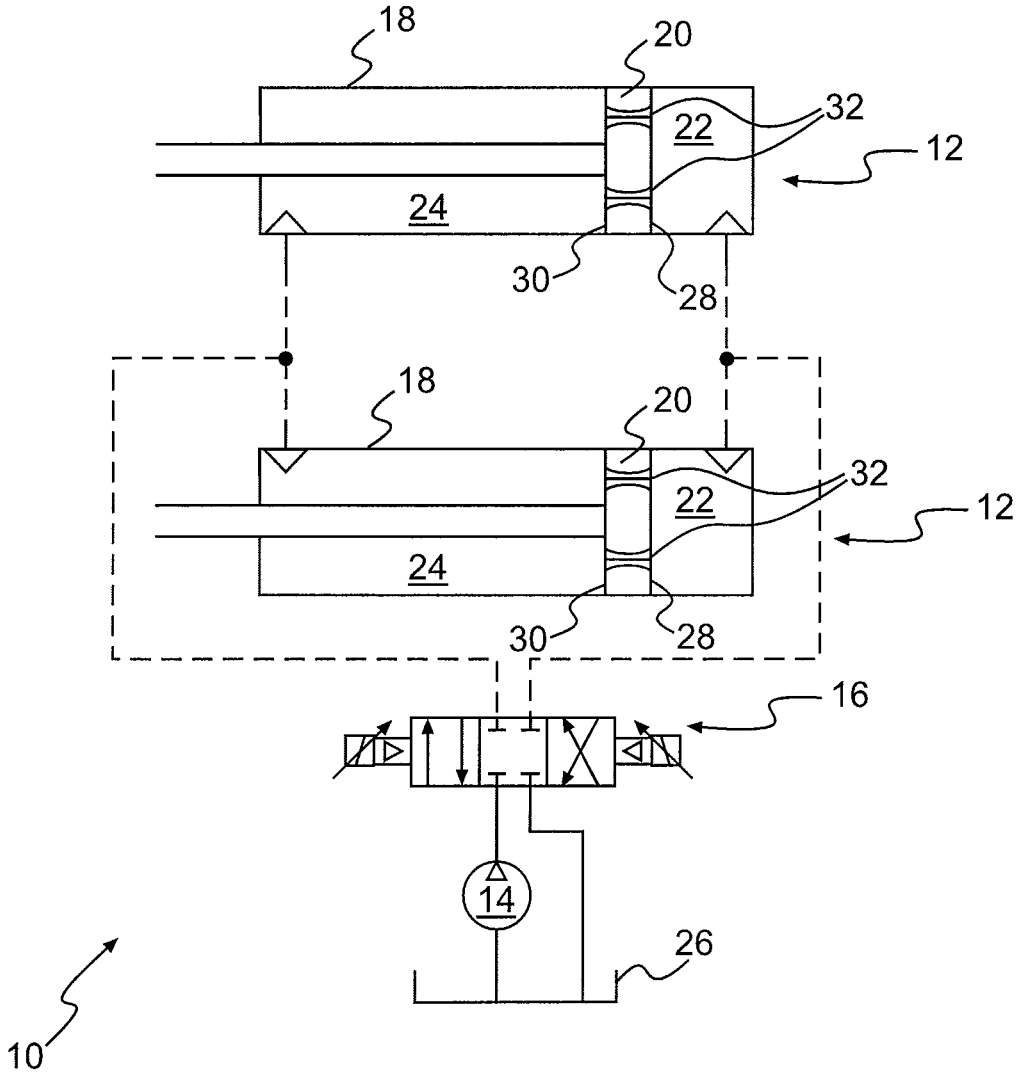
FIG. 1 is a schematic illustration of an exemplary disclosed hydraulic control system.

An exemplary disclosed hydraulic control system 10 is illustrated in FIG. 1. Hydraulic control system 10 may be associated with a machine (not shown), for example an earth moving machine, and be situated to move a linkage member and/or a work tool (also not shown) of the machine by way of one or more hydraulic cylinders 12. In particular, hydraulic control system 10 may include a source 14 of pressurized fluid, and one or more control valves 16 disposed between source 14 and hydraulic cylinders 12. Control valve 16 may move to selectively fill or drain hydraulic cylinder 12 of fluid pressurized by source 14, thereby causing movement of hydraulic cylinder 12 and the connected linkage member and/or work tool.

Hydraulic cylinder 12 may connect the linkage member and/or the work tool to a base frame (not shown) of the machine via a direct pivot, via a linkage system with hydraulic cylinder 12 forming a member in the linkage system, or in any other appropriate manner. As illustrated in FIG. 1, hydraulic cylinder 12 may include a tube 18 and a piston assembly 20 disposed within tube 18. One of tube 18 and piston assembly 20 may be pivotally connected to the base frame, while the other of tube 18 and piston assembly 20 may be pivotally connected to the linkage member and/or the work tool. It is contemplated that tube 18 and/or piston assembly 20 may alternatively be fixedly connected to either the base frame, the linkage member, and/or the work tool, if desired.

Tube 18 may be separated by piston assembly 20 to at least partially define a first or head-end chamber 22 and a second or rod-end chamber 24. First and second chambers 22, 24 may be selectively supplied with pressurized fluid from source 14 and selectively connected with a low-pressure reservoir 26 to cause piston assembly 20 to displace within tube 18, thereby changing an effective length of hydraulic cylinder 12. The expansion and retraction of hydraulic cylinder 12 may function to assist in moving the linkage member and/or the work tool.

Piston assembly 20 may include a first hydraulic surface 28 and a second hydraulic surface 30 disposed in opposition to first hydraulic surface 28. An imbalance of force caused by fluid pressure acting on first and second hydraulic surfaces 28, 30 may result in movement of piston assembly 20 within tube 18. For example, a force on first hydraulic surface 28 being greater than a force on second hydraulic surface 30 may cause piston assembly 20 to displace and increase the effective length of hydraulic cylinder 12 (i.e., to extend piston assembly 20 from tube 18). Similarly, when a force on second hydraulic surface 30 is greater than a force on first hydraulic surface 28, piston assembly 20 may retract into tube 18 and decrease the effective length of hydraulic cylinder 12. A flow rate of fluid into and out of first and second chambers 28 and 30 may relate to a velocity of hydraulic cylinder 12, while a pressure of the fluid in contact with first and second hydraulic surfaces 28 and 30 may relate to an actuation force of hydraulic cylinder 12.

During the retracting and extending movements of hydraulic cylinder 12, piston assembly 20 may move from a first end-of-stroke position corresponding to full retraction within tube 18, through a mid-stroke position, to a second end-of stroke position corresponding to full extension from tube 18. And, to help reduce collisions of piston assembly 20 with tube 18 at the end-of-stroke positions and/or to help reduce hydraulic instabilities (e.g., undesired reactionary forces) within systems having multiple fluidly-interconnected hydraulic cylinders 12, each hydraulic cylinder 12 may include one or more piston-mounted bypass valves 32. Bypass valves 32 may be mechanically actuated at the end-of-stroke positions to selectively communicate fluid between first and second chambers 22, 24, and hydraulically returned to a flow-blocking state at the mid-stroke position of piston assembly 20 to inhibit fluid communication between first and second chambers 22, 24.

Figure 2:
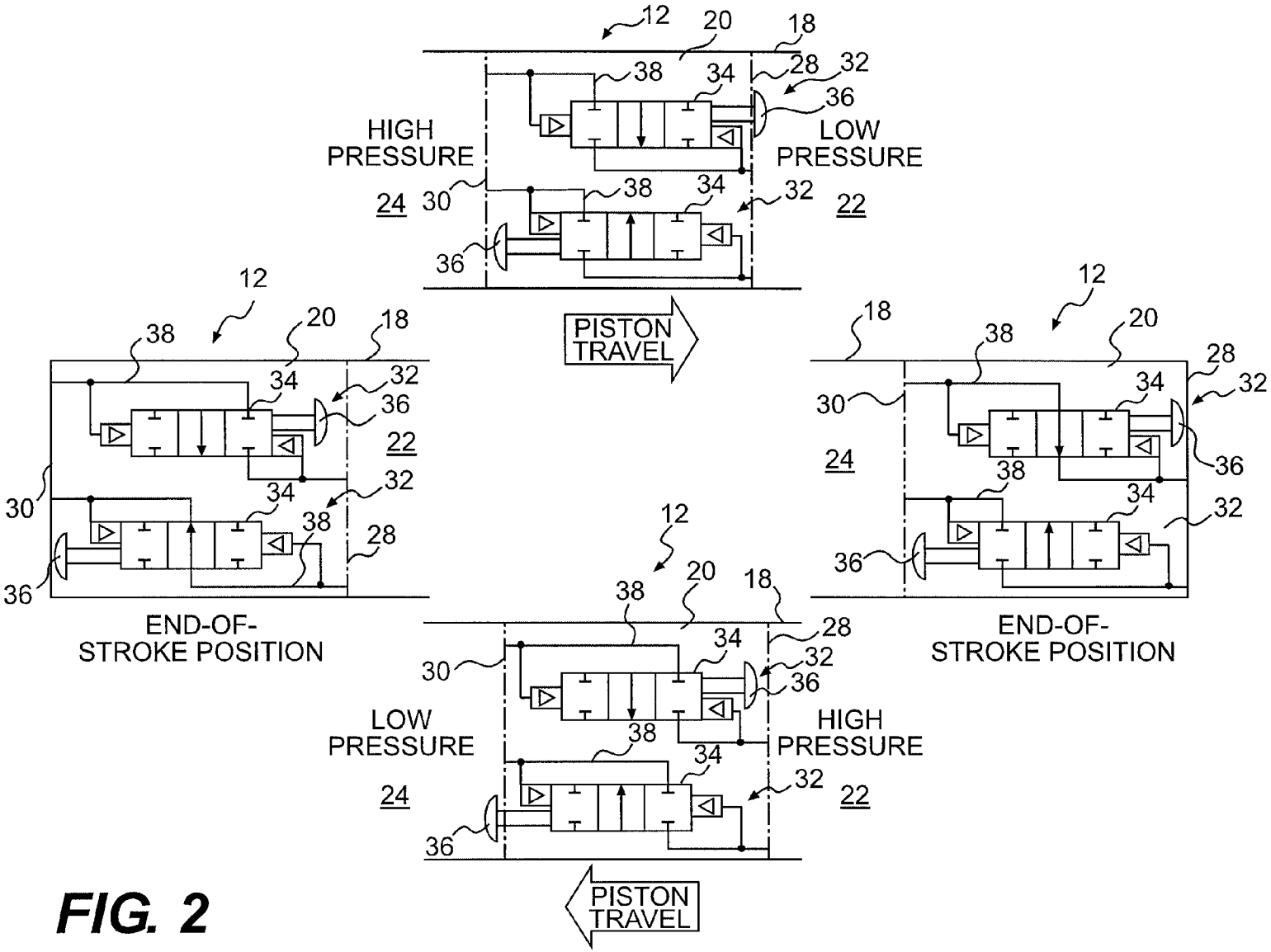
FIG. 2 is a schematic illustration of an exemplary bypass valve arrangement that may be used with the hydraulic control system of FIG. 1.

As shown in FIG. 2, bypass valve 32 may include a three-position, two-way, normally-closed valve element 34 having a rod portion 36 protruding from one end of valve element 34. In the examples shown in FIG. 2, two substantially identical bypass valves 32 may be included in each piston assembly 20, the two bypass valves 32 being oriented in opposition to each other such that rod portion 36 of one bypass valve 32 may selectively extend past first hydraulic surface 28 into first chamber 22, while rod portion 36 of the other bypass valve 32 may selectively extend past second hydraulic surface 30 into second chamber 24 (see center images of FIG. 2). Bypass valve 32 may have a length shorter than a thickness of piston assembly 20 (i.e., shorter than a length distance from first hydraulic surface 28 to second hydraulic surface 30) such that, in some conditions, bypass valve 32 may be completely contained within a bore 42 of piston assembly 20 (see left and right-most images of FIG. 2). Each valve element 34 may be associated with a passage 38 that is in fluid communication with first and second chambers 22, 24, and be movable from a first position at which fluid flow through passage 38 is inhibited, through a second position at which fluid flow through passage 38 is allowed, to a third position at which fluid flow through passage 38 is again inhibited. Valve element 34 may normally reside in one of the first and third positions.

Valve element 34 may be mechanically moved to the second position when piston assembly 20 nears an end-of-stroke position, and hydraulically moved to the first and third positions when piston assembly 20 is away from the end-of-stroke positions. Specifically, as piston assembly 20 nears an end-of-stroke position, rod portion 36 of one of bypass valves 32 may engage an end of tube 18, thereby mechanically moving the associated valve element 34 to the second position as piston assembly 20 continues travel toward the end-of-stroke position. Similarly, when piston assembly 20 nears the end-of-stroke position in the opposite travel direction, rod portion 36 of the other bypass valve 32 located within the same piston assembly 20 may engage an opposing end of tube 18, thereby mechanically moving the associated valve element 34 to the second position. When in the second position, fluid from a high-pressure of piston assembly 20 may pass to a low-pressure side of piston assembly 20 via passage 38. When piston assembly 20 moves away from the end-of-stroke positions, valve element 34 may be hydraulically moved to one of the first and third positions, thereby inhibiting fluid flow through passage 38. Operation of piston assembly 20 and valve element 34 with respect to FIG. 2 will be described in greater detail in the following section.

Figure 3:
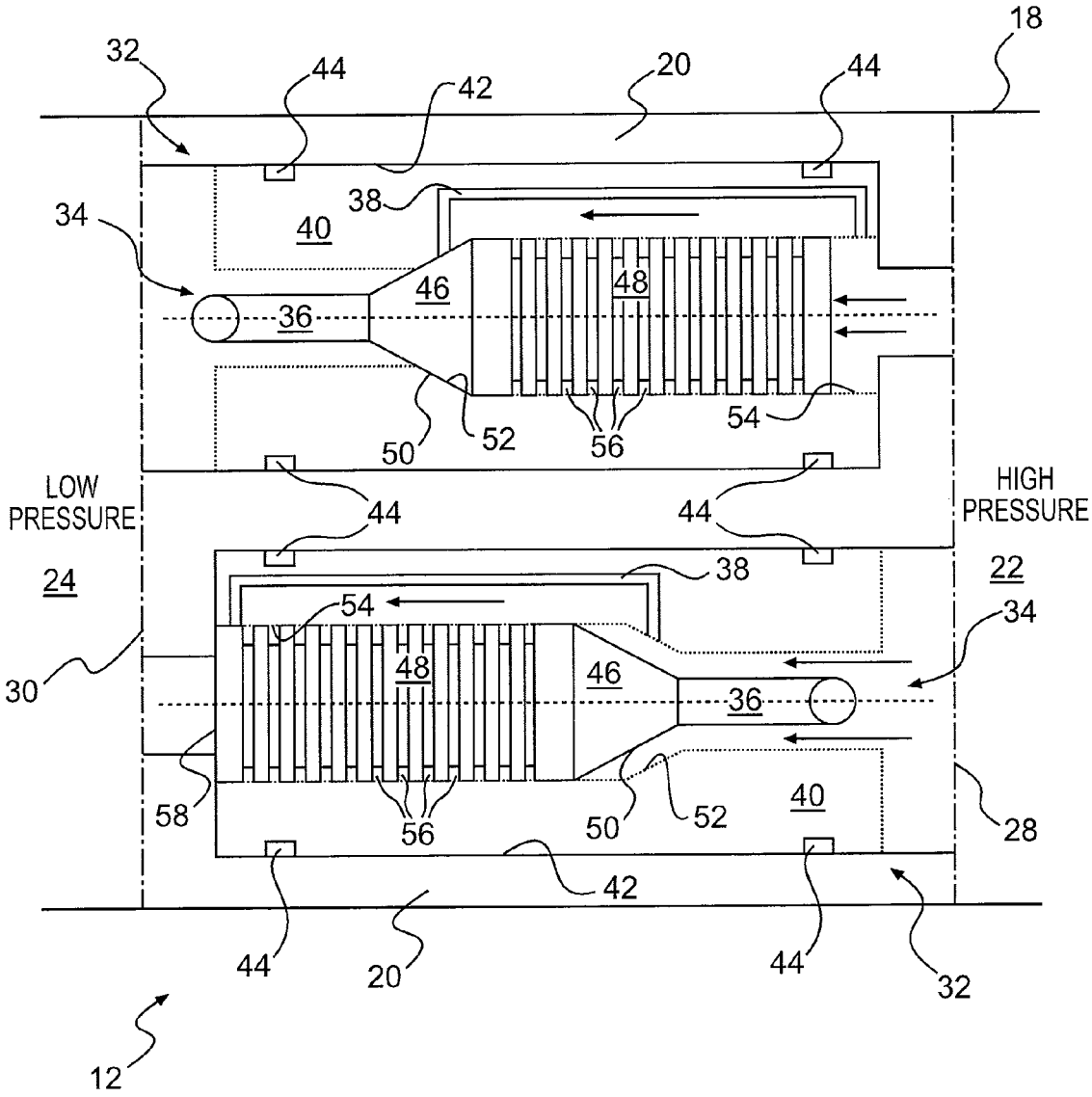
FIG. 3 is a pictorial illustration of a physical embodiment of the bypass valve arrangement of FIG. 2.

FIG. 3 illustrates one physical embodiment of bypass valve 32. In this embodiment, bypass valve 32 may be a cartridge type of valve and accordingly include a valve body 40 disposed within bore 42 of piston assembly 20 to receive valve element 34. In one example, one or more sealing elements 44 such as o-rings may be located on an outer surface of valve body 40 to inhibit fluid flow between piston assembly 20 and valve body 40. In another example, sealing elements 44 may alternatively or additionally be located at an end of valve body 40 within bore 42, if desired.

In the embodiment of FIG. 3, valve element 34 may include a poppet portion 46 integral with and located proximal rod portion 36, and a spool portion 48 integral with poppet portion 46 and located opposite rod portion 36. Poppet portion 46 may include a male conical sealing surface 50 configured to engage a female conical seating surface 52 when valve element 34 is in the first position. One end of passage 38, in this embodiment, may open within female conical seating surface 52 such that, when valve element 34 is in the first position, male conical sealing surface 50 may engage female conical seating surface 52 and thereby block the opening of passage 38. An opposite end of passage 38 may open within an interior annular wall 54 of valve body 40 such that, when valve element 34 is in the third position, spool portion 48 may block passage 38 by obstructing the opening in interior annular wall 54. When valve element 34 is between the openings of passage 38 (i.e., when valve element 34 is in the second position), passage 38 may be substantially unrestricted by valve element 34.

In one example, spool portion 48 may include geometry configured to align valve element 34 within valve body 40 and thereby minimize the likelihood of binding. Specifically, spool portion 48 may include a plurality of annular grooves 56 located along its length. When pressurized fluid is applied to either first or second hydraulic surfaces 28, 30 and enters valve body 40 (referring to FIGS. 1 and 2), the fluid may flow into annular grooves 56 and be retained therein. This pressurized fluid within annular grooves 56 may function to center valve element 34 within valve body 40.

Figure 4:
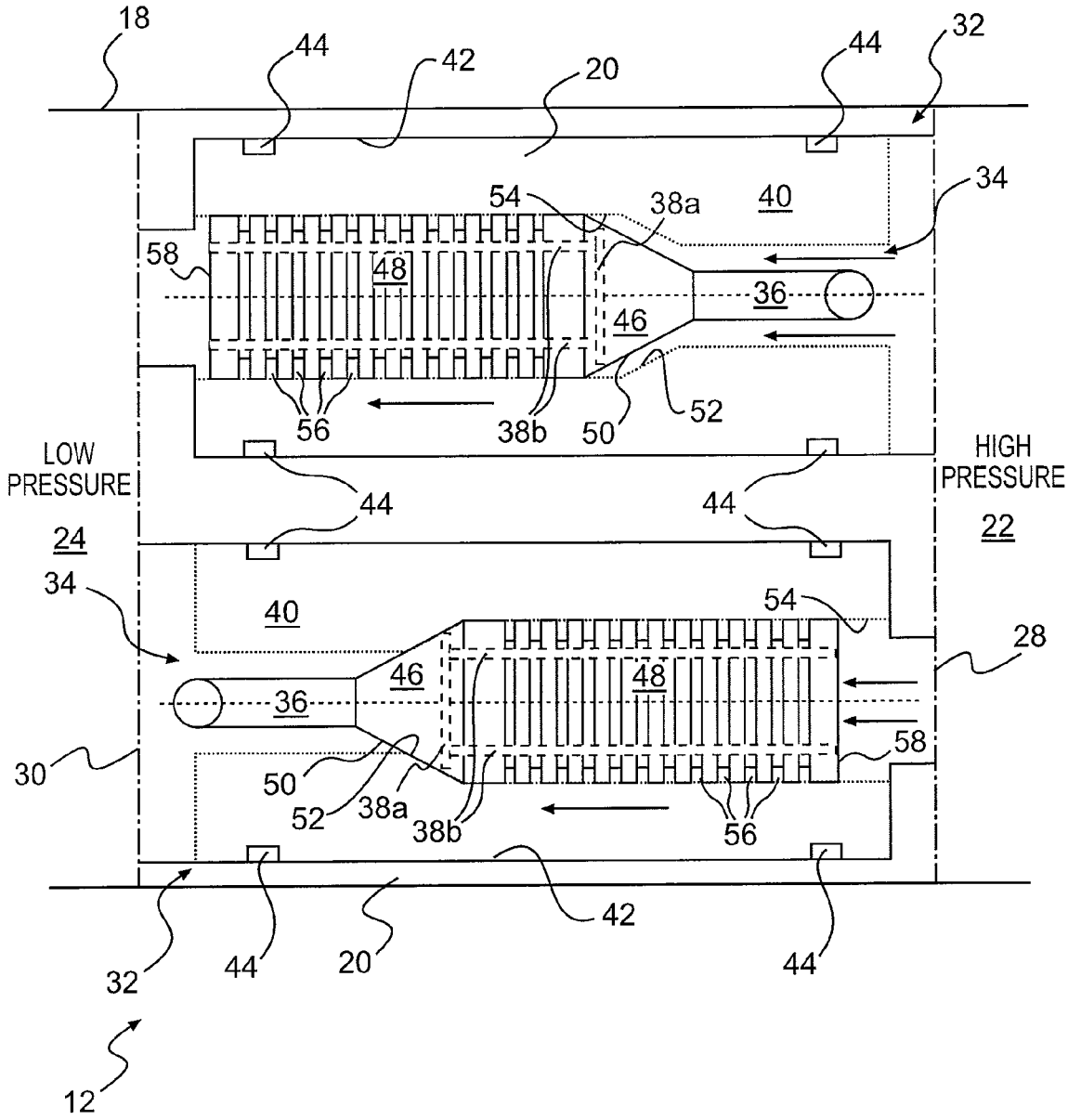
FIG. 4 is a pictorial illustration of another physical embodiment of the bypass valve arrangement of FIG. 2.

An alternative embodiment of bypass valve 32 is illustrated in FIG. 4. Similar to the embodiment of FIG. 3, bypass valve 32 of FIG. 4 may be a cartridge type of valve having valve body 40 and valve element 34 with rod portion 36, poppet portion 46, and spool portion 48. However, in contrast to the embodiment of FIG. 3, passage 38 of FIG. 4 may be located within valve element 34 rather than within valve body 40. Specifically, passage 38 is shown in FIG. 4 to extend internally along an axial length of valve element 34, and have one or more radial components 38*a* (i.e., components that extend substantially perpendicularly relative to a longitudinal axis of valve element 34) that terminate at an opening within male conical sealing surface 50, and one or more axial components 38*b* (i.e., components that extend along a direction generally aligned with the longitudinal axis of valve element 34) that terminate at an opening within an end surface 58 of spool portion 48.

Figure 5:
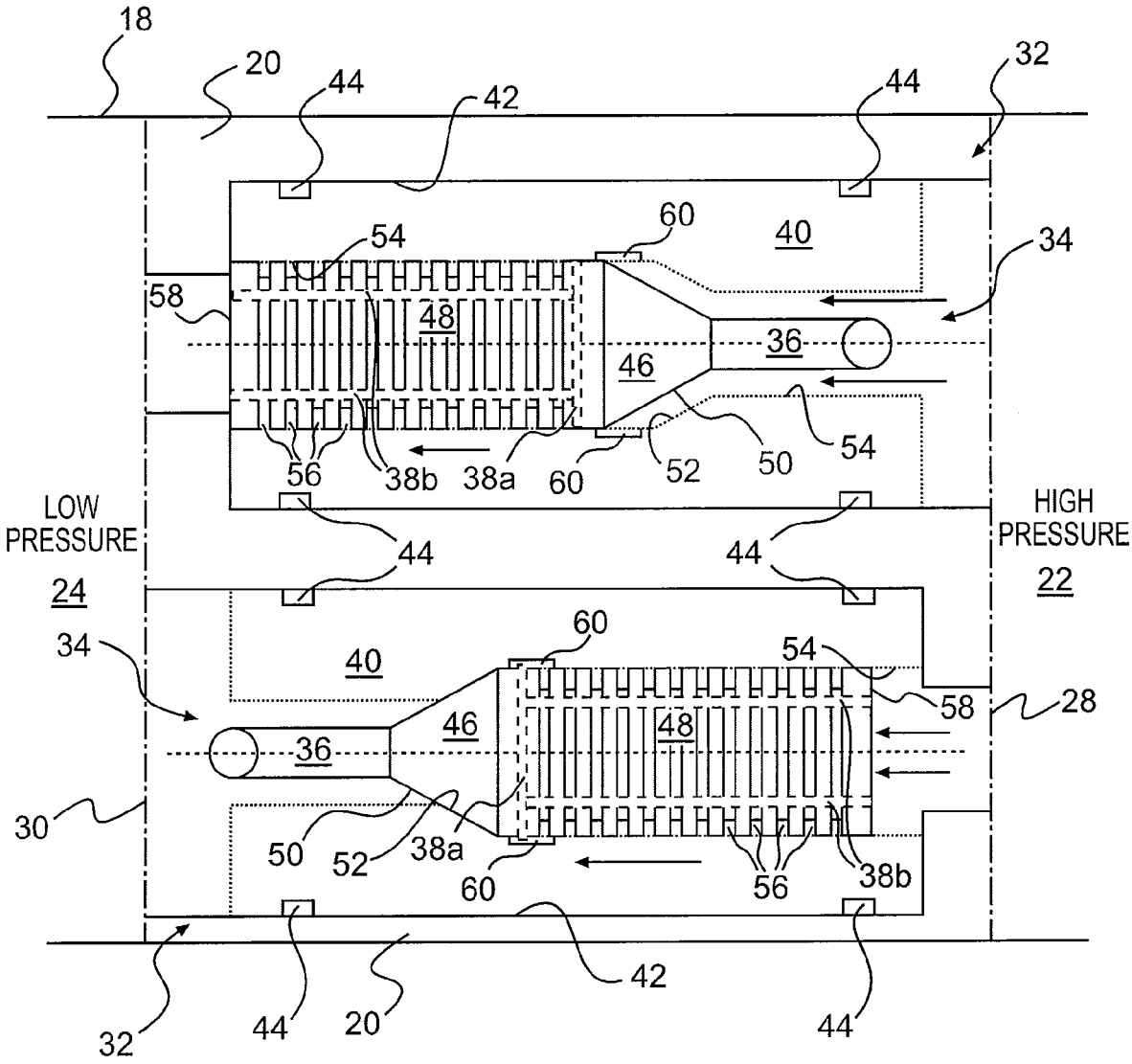
FIG. 5 is a pictorial illustration of another physical embodiment of the bypass valve arrangement of FIG. 2.

FIG. 5 shows an additional embodiment of bypass valve 32. As in the embodiment of FIG. 4, bypass valve 32 of FIG. 5 may be a cartridge type of valve having valve body 40 and valve element 34 with rod portion 36, poppet portion 46, and spool portion 48. However, in contrast to the embodiment of FIG. 4, radial components 38*a* of passage 38 are shown in FIG. 5 to terminate just short of poppet portion 46, at openings within an annular wall of spool portion 48. To enhance fluid communication between radial component 38*a* of passage 38 and bore 42, an annular recess 60 in valve body 40 may be located at the opening of radial component 38*a*. The location of radial components 38*a* of FIG. 5 may improve machinability of valve element 34.

Bypass valves 32 may be retained within piston assembly 20 by any means known in the art. For example, an annular ring-shaped face plate (not shown) may be applied to either of first and second hydraulic surfaces 28, 30 to retain bypass valve 32 within bore 42 of piston assembly 20. The face plate may be bolted to piston assembly 20, may be threadingly received within a corresponding recess of piston assembly 20, may be pressed or welded into place, or may be retained in any similar manner. Alternatively, a single circular face plate or plug may be associated with each individual bypass valve 32 and retained in a similar manner to that described above. In other examples, bypass valve 32 may threadingly engage bore 42, be pressed into bore 42, and/or held within bore 42 by way of a retention clip (e.g., a C-clip). It is contemplated that many other ways of retaining bypass valve 32 may be implemented, if desired.

Industrial Applicability

The disclosed hydraulic cylinder may be applicable to any apparatus where mechanical impact and/or fluid instability (e.g., reactionary forces) is important. In particular, the disclosed hydraulic cylinder may help reduce mechanical impact and/or fluid instability by selectively allowing fluid from a highly-pressurized chamber to bypass piston assembly 20 and enter a low-pressure chamber at an end-of-stroke position of piston assembly 20. This bypassing of fluid may help reduce piston force at the end-of-stroke position, and reduce the reactionary force in an associated fluid circuit created by the end-of stroke movement. The operation of hydraulic cylinder 12 will now be explained.

With reference to FIG. 2, when piston assembly 20 is at an end-of-stroke position, for example at a fully extended position shown in the left-most image of FIG. 2, valve element 34 of the upper bypass valve 32 may be held in the first position by hydraulic pressure within first chamber 22, while valve element 34 of the lower bypass valve 32 may be held in the second position against the pressure of first chamber 22 by the engagement of rod portion 36 with the end of tube 18. In this state, fluid flow through the upper bypass valve 32 may be inhibited, while fluid flow from first chamber 22 through the lower bypass valve 32 to second chamber 24 via passage 38 may be allowed.

Pressurized fluid from source 14 may be introduced into second chamber 24 of hydraulic cylinder 12, while fluid from first chamber 22 may be drained to low-pressure reservoir 26 to create a force differential across piston assembly 20 that causes piston assembly 20 to retract and decrease the effective length of hydraulic cylinder 12 (i.e., that causes piston assembly 20 to move to the right with respect to FIGS. 1 and 2). In this situation, high-pressure fluid acting on second hydraulic surface 30 may cause the upper bypass valve 32 to move to the right to its third position and the lower bypass valve 32 to move to the right to its first position, as shown in the upper-middle image of FIG. 2. When in the third position, rod portion 36 of the upper bypass valve 32 may extend past first hydraulic surface 28 into first chamber 22. In this state, fluid flow through both the upper and lower bypass valves 32 may be inhibited.

As piston assembly 20 continues to retract into tube 18 (i.e., as piston assembly 20 continues to move to the right with respect to FIGS. 1 and 2), piston assembly 20 may eventually near its retracting end-of-stroke position. When piston assembly 20 nears this end-of-stroke position, rod portion 36 of upper bypass valve 32 may engage the end of tube 18 and prevent further movement of valve element 34 in the same direction. As piston assembly 20 continues its rightward retracting movement, rod portion 36, because of its mechanical engagement with tube 18, may move valve element 34 to the second position. At this same time, the pressurized fluid within second chamber 24 may maintain valve element 34 of the lower bypass valve 32 in its first position, as shown in the right-most image of FIG. 2. In this state, fluid flow through the upper bypass valve 32 may be allowed from second chamber 24 to first chamber 22 via passage 38 thereby reducing the force on piston assembly 20, while fluid flow through the lower bypass valve 32 may be inhibited.

Reverse operation of hydraulic cylinder 12 (i.e., extending movement of piston assembly 20) may be mirrored with respect to the description provided above, and may be visualized through the right-most, lower-middle, and left-most images of FIG. 2. Specifically, from the state of the upper and lower bypass valves 32 shown in the right-most image of FIG. 2, pressurized fluid may be introduced into first chamber 22 and drained from second chamber 24 to extend piston assembly 20 relative to tube 18 (i.e., to move piston assembly 20 to the left with respect to FIGS. 1 and 2). As the pressurized fluid enters first chamber 22, it may act against first hydraulic surface 28 to move valve element 34 of the upper bypass valve 32 to its first position and valve element 34 of the lower bypass valve 32 to its third position, as shown in the lower-middle image of FIG. 2. As piston assembly 20 nears its extending end-of-stroke position (left-most image of FIG. 2), rod portion 36 of the lower bypass valve 32 may engage the end of tube 18 and prevent farther leftward movement of valve element 34 during travel of piston assembly 20, causing valve element 34 to move to its second position and bypass fluid from first chamber 22 to second chamber 24 and thereby lowering the force on piston assembly 20. Valve element 34 of the upper bypass valve 32 may remain in the first position during this time to inhibit fluid flow.

Several benefits may be associated with the disclosed hydraulic cylinder. For example, because bypass valve 32 may incorporate poppet geometry to control fluid flow, leakage of bypass valve 32 may by low and flow control thereof high. Further, because of annular grooves 56, spool portion 48 may have reduced likelihood of misalignment relative to bore 42, resulting in improved reliability of hydraulic cylinder 12. In addition, because bypass valve 32 may utilize only a single moving component, the durability of hydraulic cylinder 12 may be high.

It will be apparent to those skilled in the art that various modifications and variations can be made to the disclosed hydraulic cylinder. Other embodiments will be apparent to those skilled in the art from consideration of the specification and practice of the disclosed hydraulic cylinder. It is intended that the specification and examples be considered as exemplary only, with a true scope being indicated by the following claims and their equivalents.

What is claimed is:

1. A hydraulic cylinder, comprising:

a tube;

a piston disposed within the tube and having a bore passing through the piston;

a valve element disposed within the bore and having a length shorter than a length of the bore; and a protruding rod portion;

wherein the valve element is mechanically movable via the protruding rod portion to allow fluid flow through the bore, and hydraulically movable to inhibit fluid flow through the bore.

2. The hydraulic cylinder of claim 1, wherein the valve element includes the protruding rod portion, and wherein the protruding rod portion is configured to engage an end of the tube when the piston is at an end-of stroke position to mechanically move the valve element relative to the piston.

3. The hydraulic cylinder of claim 2, wherein the piston includes a second bore and the hydraulic cylinder further includes a second valve element disposed within the second bore, the second valve element being mechanically movable to allow fluid flow through the second bore, and hydraulically movable to inhibit fluid flow through the second bore.

4. The hydraulic cylinder of claim 3, wherein the second valve element includes a second protruding rod portion configured to engage a second end of the tube when the piston is at a second end-of-stroke position to mechanically move the second valve element relative to the piston.

5. The hydraulic cylinder of claim 2, wherein the valve element includes a poppet portion and a spool portion extending from the poppet portion.

6. The hydraulic cylinder of claim 5, wherein the protruding rod portion extends from the poppet portion in opposition to the spool portion.

7. The hydraulic cylinder of claim 5, further including a plurality of annular grooves located along an outer surface of the spool portion and configured to retain fluid between the valve element and an inner surface of the bore.

8. The hydraulic cylinder of claim 1, further including a valve body disposed within the bore and being configured to receive the valve element, and a passage fluidly communicating a first end of the bore with a second end of the bore, wherein the valve element is movable to selectively block the passage.

9. The hydraulic cylinder of claim 1, wherein the valve element includes a passage extending from a first end of the valve element to an opposing second end of the valve element, the valve element being movable to selectively block the passage.

10. The hydraulic cylinder of claim 9, wherein the passage at the first end opens to a conical sealing surface of the valve element, and the passage at the second end opens to an end of the valve element that is substantially perpendicular to a longitudinal axis of the valve element.

11. The hydraulic cylinder of claim 9, wherein the passage at the first end opens to a radial surface of the valve element generally aligned with a longitudinal axis of the valve element, and the passage at the second end opens to an end of the valve element that is substantially perpendicular to the longitudinal axis.

12. A hydraulic cylinder, comprising:

a tube;

a piston disposed within the tube and having a first hydraulic surface and a second hydraulic surface disposed in general opposition to the first hydraulic surface;

a valve body disposed within the piston and having formed therein a bore, and a passage fluidly communicating the first hydraulic surface with the second hydraulic surface; and a valve element disposed within the bore of the valve body and being movable from a first position at which fluid flow through the passage is inhibited, toward a second position at which fluid flow through the passage is allowed;

wherein the piston includes a second bore and the hydraulic cylinder further includes a second valve element disposed within the second bore, the second valve element being movable to selectively allow fluid flow through the second bore.

13. The hydraulic cylinder of claim 12, wherein the valve element includes a protruding rod portion configured to engage an end of the tube when the piston is at an end-of stroke position to move the valve element relative to the piston.

14. The hydraulic cylinder of claim 12, wherein the second valve element includes a second protruding rod portion configured to engage a second end of the tube when the piston is at a second end-of-stroke position to move the second valve element relative to the piston.

15. The hydraulic cylinder of claim 14, wherein the valve element includes a poppet portion and a spool portion extending from the poppet portion, and the protruding rod portion extends from the poppet portion in opposition to the spool portion.

16. The hydraulic cylinder of claim 15, further including a plurality of annular grooves located along an outer surface of the spool portion and configured to retain fluid between the valve element and an inner surface of the bore.

17. A hydraulic cylinder, comprising:

a tube;

a piston disposed within the tube and having a first hydraulic surface, a second hydraulic surface disposed in general opposition to the first hydraulic surface, and a bore passing through the piston from the first hydraulic surface to the second hydraulic surface; and a poppet valve element disposed within the bore and having formed therein a passage fluidly communicating the first hydraulic surface with the second hydraulic surface, wherein the poppet valve element is movable from a first position at which fluid flow through the passage is inhibited, toward a second position at which fluid flow through the passage is allowed, and the piston includes a second bore and the hydraulic cylinder further includes a second valve element disposed within the second bore, the second valve element being movable to selectively allow fluid flow through the second bore.

18. The hydraulic cylinder of claim 17, wherein the poppet valve element includes a protruding rod portion configured to engage an end of the tube when the piston is at an end-of stroke position to move the poppet valve element relative to the piston.

19. The hydraulic cylinder of claim 18, wherein the poppet valve element includes: a poppet portion and a spool portion extending from the poppet portion, the protruding rod portion extending from the poppet portion in opposition to the spool portion; and a plurality of annular grooves located along an outer surface of the spool portion and configured to retain fluid between the poppet valve element and an inner surface of the bore.

* * * * *